US010030460B2

(12) United States Patent
Beach et al.

(10) Patent No.: US 10,030,460 B2
(45) Date of Patent: Jul. 24, 2018

(54) HEAD ASSEMBLY

(71) Applicant: Imdex Global B.V., Amsterdam Zuidoost (NL)

(72) Inventors: Andrew Beach, Boddington (AU); Gavin McLeod, Attadale (AU); Ben Blakeway, Beaconsfield (AU)

(73) Assignee: Reflex Instruments Asia Pacific PTY LTD, Balcatta, Western Australia (AU)

( * ) Notice: Subject to any disclaimer, the term of this patent is extended or adjusted under 35 U.S.C. 154(b) by 395 days.

(21) Appl. No.: 14/736,541

(22) Filed: Jun. 11, 2015

(65) Prior Publication Data

US 2015/0275603 A1 Oct. 1, 2015

Related U.S. Application Data

(62) Division of application No. 13/203,312, filed as application No. PCT/AU2010/000194 on Feb. 22, 2010, now Pat. No. 9,103,178.

(30) Foreign Application Priority Data

Feb. 25, 2009 (AU) ..... 2009900823

(51) Int. Cl.

| | |
|---|---|
| ***E21B 31/20*** | (2006.01) |
| *E21B 25/02* | (2006.01) |
| *E21B 23/02* | (2006.01) |

(52) U.S. Cl.

CPC ..... *E21B 31/20* (2013.01); *E21B 23/02* (2013.01); *E21B 25/02* (2013.01)

(58) Field of Classification Search

CPC ..... E21B 31/20

See application file for complete search history.

(56) References Cited

U.S. PATENT DOCUMENTS

| | | | |
|---|---|---|---|
| 2,153,815 | A | 4/1939 | Snyder |
| 2,324,160 | A | 7/1943 | Hoffoss |

(Continued)

FOREIGN PATENT DOCUMENTS

| | | |
|---|---|---|
| CN | 86106661 | 5/1988 |
| GB | 510587 | 8/1939 |

(Continued)

OTHER PUBLICATIONS

Australian Patent Office, International Preliminary Report on Patentability dated Jun. 1, 2011, PCT/AU2010/000194.

(Continued)

*Primary Examiner* — D. Andrews
*Assistant Examiner* — Kristyn A Hall
(74) *Attorney, Agent, or Firm* — Sunstein Kann Murphy & Timbers LLP

(57) ABSTRACT

A spear head assembly includes a spear point having a proximal end and an opposite pointed end. A sleeve has an axial passage and a first end from which the spear point extends, the spear point coupled to the sleeve wherein the spear point can pivot relative to the sleeve and move axially relative to the sleeve. The first end of the sleeve has a smooth continuous abutment surface for the spear point, and the abutment surface forms a funnel like structure which reduces in inner diameter in a direction inward of the sleeve, with the funnel like structure extending between an outer circumferential surface and an inner circumferential surface of the sleeve.

8 Claims, 12 Drawing Sheets

(56) References Cited

U.S. PATENT DOCUMENTS

| | | | | |
|---|---|---|---|---|
| 3,346,059 | A | 10/1967 | Svendsen | |
| 3,554,304 | A | 1/1971 | Link | |
| 3,603,413 | A | 9/1971 | Grill | |
| 3,818,997 | A | 6/1974 | Bridwell | |
| 4,281,725 | A | 8/1981 | Runk | |
| 4,418,770 | A | 12/1983 | Lambot | |
| 6,045,171 | A * | 4/2000 | McLeod | E21B 21/00 166/98 |
| 2009/0283327 | A1 | 11/2009 | Drenth | |
| 2009/0283329 | A1 * | 11/2009 | Able | E21B 7/24 175/246 |

FOREIGN PATENT DOCUMENTS

| | | | |
|---|---|---|---|
| WO | WO 97/08379 | 3/1997 | |
| WO | WO 97/18382 | 5/1997 | |
| WO | WO 2004/018831 | 3/2004 | |
| WO | WO-2008/0109522 A1 * | 9/2008 | E21B 10/00 |

OTHER PUBLICATIONS

European Patent Office, Extended European Search Report, Application No. EP 10745719, 11 pages, dated May 31, 2017.

* cited by examiner

HEAD ASSEMBLY

This application is a divisional of co-pending U.S. patent application Ser. No. 13/203,312, filed Dec. 9, 2011, which in turn is a national phase entry of Patent Cooperation Treaty Application PCT/AU2010/000194, filed Feb. 22, 2010, which claimed priority from Australian Patent Application 2009900823, filed Feb. 25, 2009; all of which are incorporated herein by reference in their entireties.

TECHNICAL FIELD

The present invention relates to a head assembly for tripping an apparatus through a tube or conduit, for example a head assembly for tripping an inner core barrel through a drill string.

BACKGROUND ART

In core drilling, a core tube is suspended inside a drill string for receiving a core sample of ground being cut by a core drill. The core tube is coupled to the head assembly enabling the core tube to be: lowered into the drill string and locked in place while a core sample is being cut and, subsequently retrieved from the drill string once the drilling is ceased to enable the core sample to be analyzed. The head assembly comprises a spear point at an up hole end which engages an overshot attached to a wire line. To lower the head assembly and core tube through the drill string the overshot is engaged with the spear point and the wire line is wound out so that the head assembly travels by action of gravity down the drill string. To prevent the core tube being pushed back by an advancing core sample being cut by the core drill, the head assembly may also comprise a latching system which engages a latching seat, such as a recess or shoulder inside the drill string. When the head assembly is to be retrieved an upward force applied by the wire line is transmitted via the head assembly to the latching system to disengage from the recess or shoulder enabling the head assembly to be retrieved from the core drill.

SUMMARY

A first aspect of the invention provides a spear head assembly comprising:

a spear point having a proximal end and an opposite pointed end;

a sleeve having an axial passage and a first end from which the spear point extends, the spear point coupled to the sleeve wherein the spear point can pivot relative to the sleeve and move axially relative to the sleeve;

the first end of the sleeve having a smooth continuous abutment surface for the spear point, the abutment surface forming a funnel like structure which reduces in inner diameter in a direction inward of the sleeve, the funnel like structure extending between an outer circumferential surface and an inner circumferential surface of the sleeve.

The funnel like structure may comprise a radiused transition to the inner circumferential surface of the sleeve.

The spear head assembly may comprise a first spring biasing the spear point inward of the sleeve.

The spear head assembly may comprise a post pivotally coupled with the spear point about a pivot axis enabling the spear point to pivot relative to the sleeve, and wherein the first spring acts between the post and the sleeve to bias the spear point inward of the sleeve.

The spear point may pivot about the pivot axis between a central position where a longitudinal axis of the spear point is substantially parallel to the central axis of the sleeve, and one or more offset positions where the longitudinal axis of the spear point is not parallel to the central axis of the sleeve, and wherein the pivot axis moves axially relative to the sleeve as the spear point moves between the central position and one or more of the offset positions.

The spear point may be biased toward the central position.

The spear head assembly may comprise a detent mechanism which holds the spear point in one or more of the offset positions against the bias applied by the sleeve.

The detent mechanism may comprise a plurality of recesses formed on an outer surface of the spear point and a member biased to seat in the or each recess.

The spear head assembly may comprise a detent spring retained in the post, and wherein the member is disposed between the pivot axis and the detent spring.

The detent mechanism releasably holds the spear point in the central position.

The spear point may be rotatable about the central axis of the sleeve.

A second aspect of the invention provides a latch system for latching an apparatus to a latching member inside a tube through which the apparatus can travel, the latching system comprising:

a latch body;

a latch carrier slideably retained in the latch body, the latch body provided with a longitudinal slot;

two or more latch dogs coupled to the latch body, each latch dog formed with at least two slots; and a plurality of pins, each pin coupled at its opposite ends to the latch body and wherein respective pins pass through one of the slots on each of the latch dogs and through the longitudinal slot in the latch carrier;

the latching system having a latch position where the latch dogs extend from the latch body to a location enabling engagement with the latching member, and a release position where the latch dogs retract into the latch body to a position where the latching system can pass through the latching member, wherein the latch dogs move parallel to each other when the latching system moves between the latch position and the release position.

The latch system may comprise a bias mechanism arranged to bias the latch system toward the latch position, wherein the bias mechanism couples the latch carrier to the latch body.

The bias mechanism may comprise: a mechanical fastener which engages the latch body and the latch carrier; and a latch spring retained about the mechanical fastener.

Each latch dog may be provided with a latch face which can engage the latching member when the latch system is in the latch position, and each latch face may slope away from the latch member in a direction opposite a direction of movement of the latch dogs when the latch system moves from the latch position to the release position.

In one embodiment the slots in a particular latch dog are of identical shape, and wherein the slots in respective latch dogs are disposed in a mirror image orientation.

In one embodiment each latch dog slot comprises at least one section that extends diagonally relative to a longitudinal axis of the latch body.

In an alternate embodiment the slots may comprise at least two sections that extend at different angles diagonally of the longitudinal axis.

Each latch dog may comprise a brake pad having a brake surface orientated to contact an inside surface of the tube as the apparatus is lowered through the tube.

A third aspect of the invention provides a brake system for an apparatus adapted to travel through a tube, the braking system comprising:

a latch body;

a latch carrier slideably retained in the latch body, the latch body provided with a longitudinal slot;

two or more latch dogs coupled to the latch body, each latch dog formed with at least two slots; and a plurality of pins, each pin coupled at its opposite ends to the latch body and wherein respective pins pass through one of the slots on each of the latch dogs and through the longitudinal slot in the latch carrier;

the latching system having a latch position where the latch dogs extend from the latch body to a location enabling engagement with the latching member, and a release position where the latch dogs retract into the latch body to a position where the latching system can pass through the latching member, wherein the latch dogs move parallel to each other when the latching system moves between the latch position and the release position.

The brake system may comprise a bias mechanism arranged to bias the brake system toward the brake position.

A fourth aspect of the invention provides a head assembly comprising:

a spear head assembly according to the first aspect of the invention; and, a latching system coupled to the spear head assembly, the latching system adapted to latch the head assembly to a latching member disposed within a tube through which the head assembly travels.

A fifth aspect of the invention provides a head assembly comprising:

the latching system according to a second aspect of the invention; and, a spear head assembly attached to the latching system enabling the head assembly to be releasably attached to an overshot.

A sixth aspect of the invention provides a head assembly comprising:

a spear head assembly according to the first aspect of the invention; and, a latching system according to the second aspect of the invention, wherein the spear head assembly is attached to the latching system.

DETAILED DESCRIPTION

Figure 1:
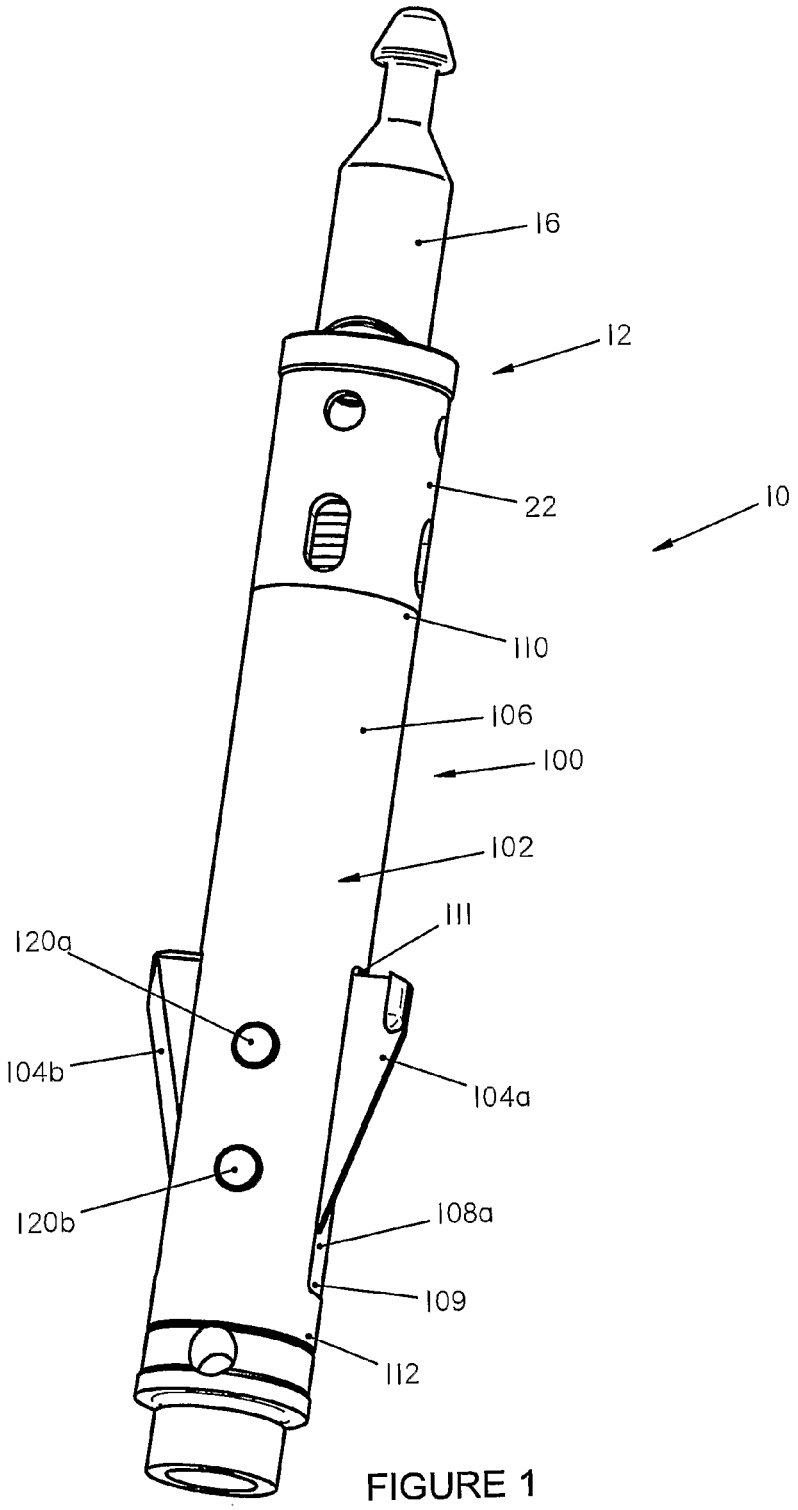
FIG. 1 is a schematic representation of an embodiment of the head assembly incorporating an embodiment of a spear point and a latching system, where the latching system is shown in a latched position.

FIGS. 1, 2, 7 and 8 depict an embodiment of a head assembly 10 which may be used for tripping an apparatus or tool such as an inner core barrel through a tubular structure such as a drill string. The head assembly 10 comprises two major subsystems, a spear head assembly 12 and a latching system 100 connected to the spear head assembly 12. The spear head assembly 12 enables the head assembly 10 to be coupled to an overshot and a wire line enabling the head assembly 10 to be tripped through (i.e. lowered into and retrieved from) a drill string. Latching system 100 enables the head assembly 10 to selectively engage a latching mechanism inside the drill string to hold the head assembly 10 against motion in at least one direction relative to the drill string, which in this embodiment, is an up hole direction. A further embodiment of the spear head assembly 10 may comprise a spear head assembly 12 as described hereinafter together with a prior art latching system. An alternate embodiment of the head assembly may comprise a latching system 100 as described hereinafter and a prior art spear head assembly.

The spear head assembly 12 will now be described in greater detail with reference to FIGS. 3-6. The spear head assembly 12 comprises a spear point 16 having a proximal end 18 pivotally coupled about a pivot axis 20, and a sleeve 22 that is biased in a direction toward a pointed end 24 of the spear point 16. The sleeve 22 is coupled with the spear point 16 so that the spear point 16 and the pivot axis 20 can move axially relative to the sleeve 22.

Figure 3:
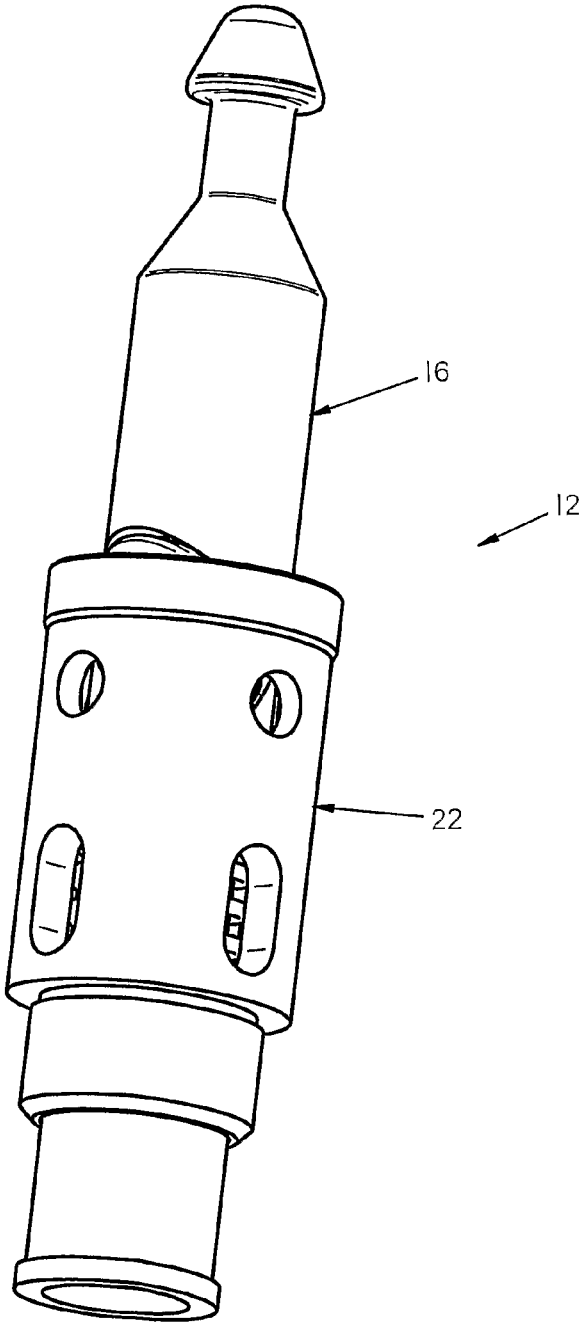
FIG. 3 is a schematic representation of the spear head assembly shown in FIGS. 1 and 2 where a spear point of the spear head assembly is depicted in a central position.
Figure 4:
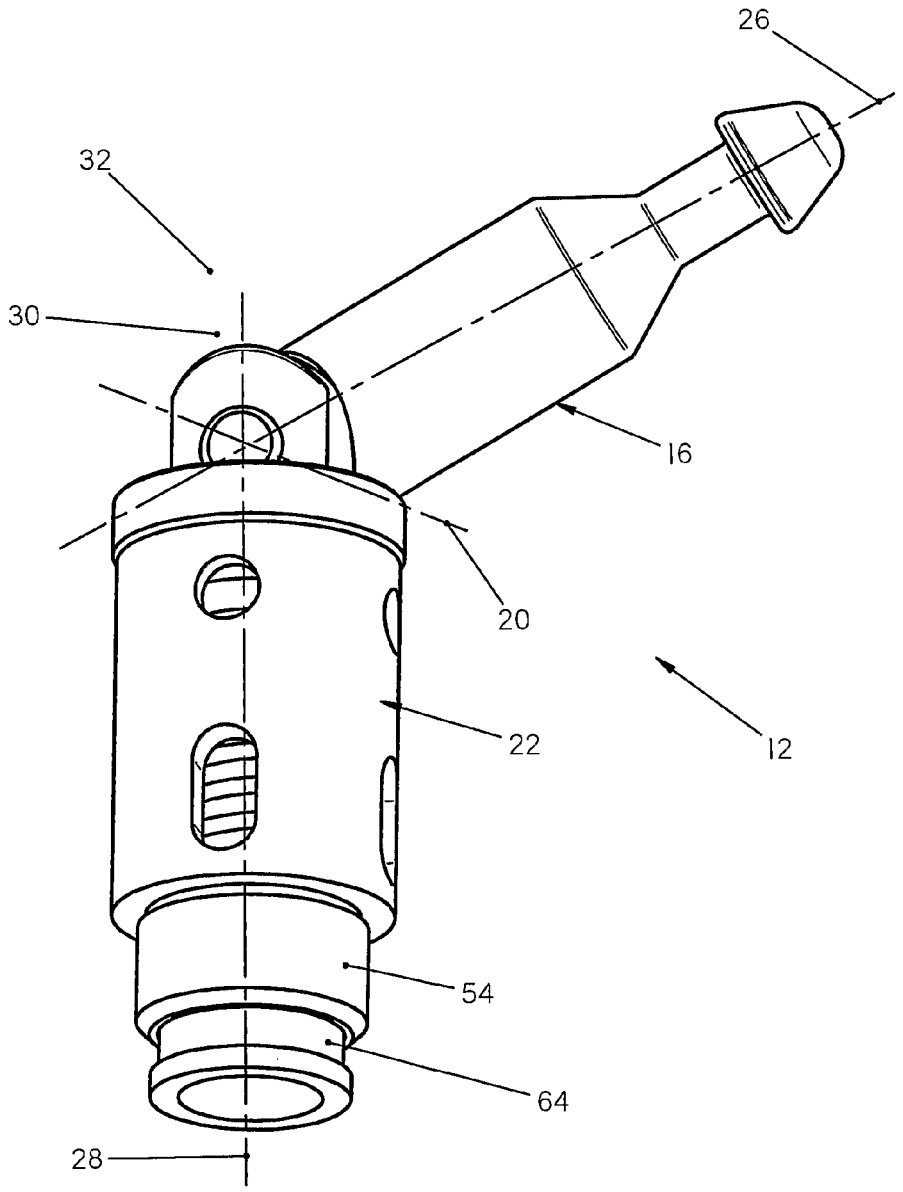
FIG. 4 illustrates the spear head assembly shown in FIG. 3 but with the spear point in an offset position.
Figure 5:
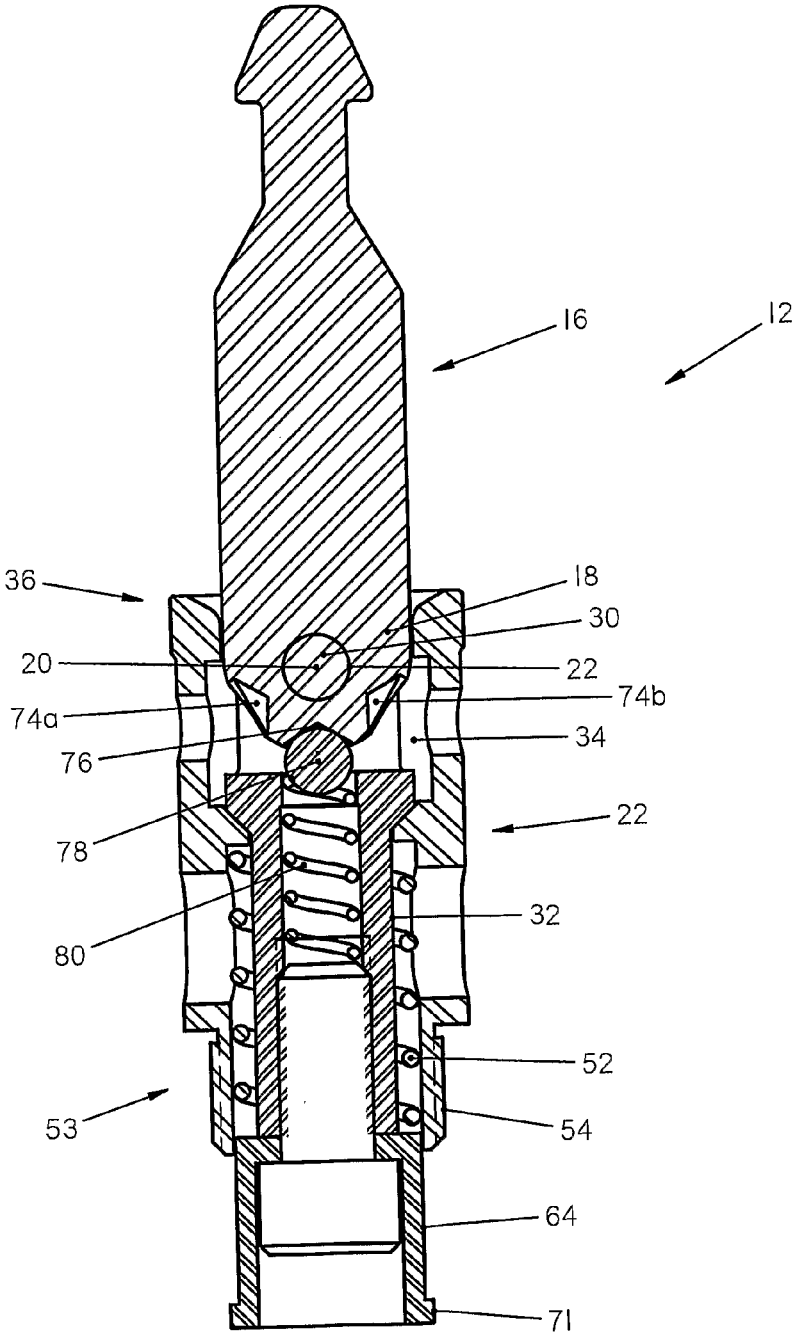
FIG. 5 is a longitudinal section view of the spear head assembly shown in FIG. 3.
Figure 6:
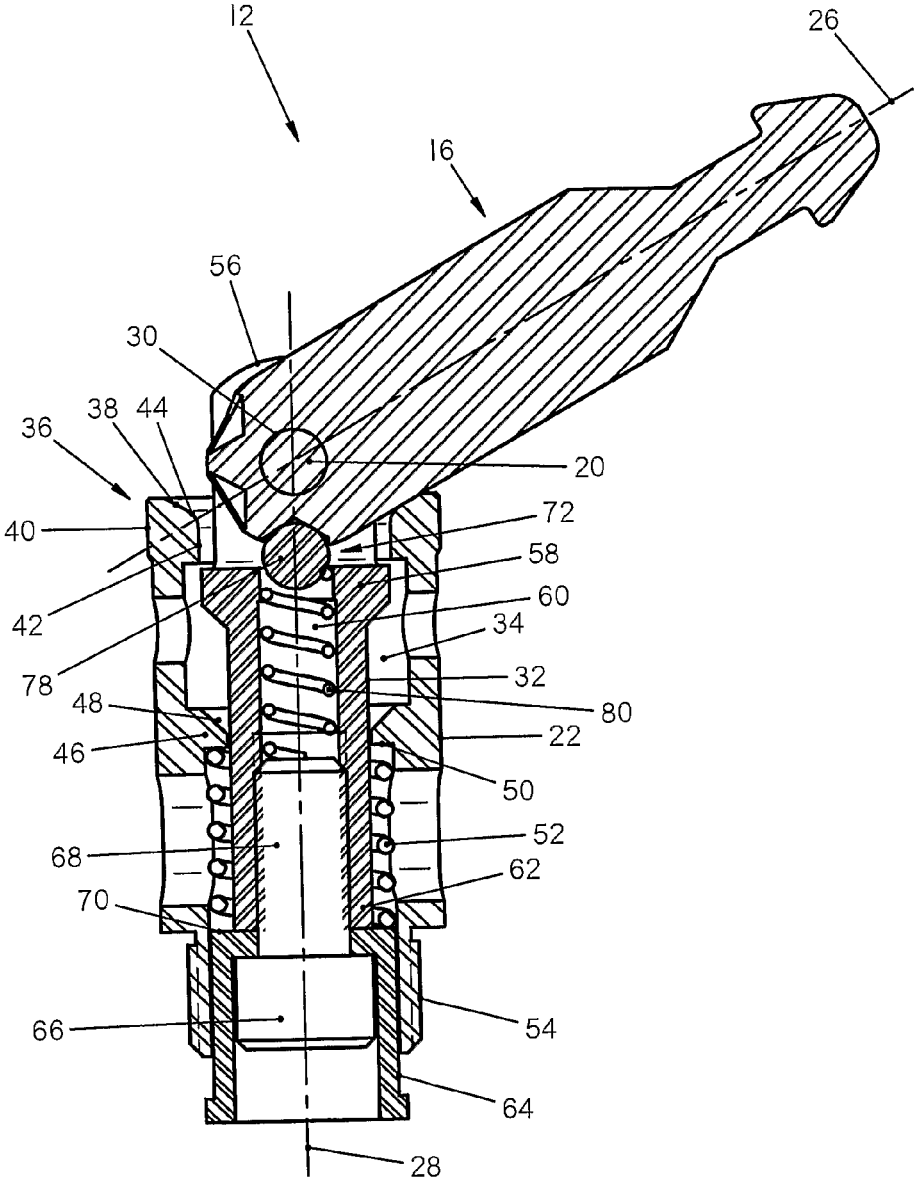
FIG. 6 is a section view of the spear head assembly shown in FIG. 4.

The spear point 16 is able to pivot about the pivot axis 20 between: a central position shown in FIGS. 3 and 5 where a longitudinal axis 26 of the spear point 16 is substantially parallel to a central axis 28 of the sleeve; and, one or more offset positions shown in FIGS. 4 and 6 where the longitudinal axis 26 of the spear point is inclined from and thus not parallel to the central axis 28. The pivot axis 20 corresponds with a central longitudinal axis of a pivot pin 30 which pivotally couples the spear pint 16 to a support post 32. From a comparison of FIGS. 5 and 6, it can be seen that when the spear point 16 is moved between its central position (FIG. 5) and an offset position (FIG. 6) there is a relative linear movement between the pivot axis 20 and the sleeve 22 along the central axis 28. Thus there is an axial displacement between the pivot axis 20 and the sleeve 22 as the spear point 16 moves between the central position and an offset position.

The sleeve 22 is provided with an axial passage through which the post 32 extends and into which the proximal end 18, pivot axis 20, and pivot pin 30 retract when the spear point 16 is in the central position (see FIG. 5). A first or up hole end 36 of the sleeve 22 from which the spear point 16 extends is formed with a smooth continuous abutment surface 38 (see FIG. 6) which transitions between an outer circumferential surface 40 and an inner circumferential surface 42 of the sleeve 22. The abutment surface 38 reduces in inner diameter from the outer surface 40 to the inner surface 42 forming a funnel like structure having a radiused transition 44 to the inner surface 42.

An internal circumferential ledge 46 is provided in the sleeve 22. An up hole side of the ledge 46 is recessed to form a seat 48 while on the opposite side of the ledge 46 forms a shoulder 50 against which one end of a sleeve spring 52 abuts. A distal end 53 of the sleeve 22 opposite to the end 36 is provided with a reduced diameter boss 54 which is formed with a screw thread on its outer circumferential surface to enable coupling of the spear head assembly 12 to the latching system 100. The spring 52 biases the spear point 16 and the pivot axis 20 toward the distal end 53 of the sleeve 22, i.e. inwardly of the sleeve.

The post 32 is provided with a slot at an end 56 adjacent the end 36 of the sleeve 22 for receiving the proximal end 18 of the spear point 16. The slot in the end 56 in effect creates a bifurcation in the end 56 through which the pivot pin 30 passes thereby pivotally attaching the spear point 16 to the post 32. Inward of the end 56, the post 32 has, about its outer surface, an outwardly flared portion 58 which is configured to engage the seat 48 when the spear point 16 is in the central position (see FIG. 5). The abutment between the outwardly flared portion 58 and the seat 48 prevents the post 32 from falling out of the sleeve 22 and thus maintains the coupling between the spear point 16 and the sleeve 22. An axial hole 60 is formed in the post 32 extending from the outwardly flared portion 58 to an end 62 distant the end 56.

A cup 64 having an increased outer diameter relative to the post 32 is attached to the end 62 by a bolt 66. The bolt 66 is provided with a shank 68 that threadingly engages an internal surface of the passage 60. The change in outer diameter between the post 32 and the cup 64 forms a shoulder 70 against which the spring 52 abuts. An outer diameter of the cup 64 is marginally smaller than an inner diameter of the boss 54 providing sufficient clearance for axial motion of the post 32 while retaining the spring 52 on the shoulder 70. The cup 64 is also provided with an outer circumferential shoulder 71 at its distal end (see FIG. 6) which creates a stop against the end of the boss 54 to limit the axial movement of the spear point 16 and thus prevent overloading the spring 52.

A detent mechanism 72 is provided which holds the spear point 16 in an offset position against the bias of the spring 52. Indeed, the detent mechanism 72 as explained hereinafter, also operates to releasably hold the spear point 16 in the central position.

The detent mechanism 72 comprises in combination, recesses 74*a*, 74*b*, and 76 formed on an outer surface of a spear point 16 at the distal end 18 about the pivot axis 20, and a member in the form of a ball 78 which is biased in a direction to enter and seat in the one of the recesses 74*a*, 74*b* or 76 when in alignment with the ball 78. The ball 78 has dimensions so that it can retract into the passage 60 and is biased toward the recesses by a detent spring 80. The spring 80 bears at one end against the ball 78 and at an opposite end against the shank 68 of the bolt 66. As a result of the coupling between the post 32 and the sleeve 22, the post 32 and thus the spear point 16 is able to rotate about the central axis 28. In addition, as described above, the spear point 16 and the pivot axis 20 can move axially relative to the pivot axis 28 and the sleeve 22.

When the spear assembly 12 is located inside a drill string, the spear point 16 should be in the central position to ensure engagement with an overshot. However, at other times when the spear head assembly is attached to an apparatus located at ground level, to facilitate easier handling, it is advantageous for the spear point 16 to be in an offset position.

When the spear head assembly is arranged so that the spear point 16 is in a the central position shown in FIGS. 3 and 5, the detent mechanism 72 acts to releasably lock the spear point 16 in this position by virtue of the ball 78 being biased into the recess 76 by the detent spring 80. When in this position, the spring 52 is in a relatively relaxed state and the pivot axis 20 and proximal end 18 of the spear point 16 are located inward of the end 36 of the sleeve 22. In addition, the outwardly flared portion 58 of the post 32 is seated in the seat 48. An outer diameter of the spear point 16 is made marginally smaller than the inner diameter of the inner circumferential surface 42 so as to provide minimal clearance there between.

In order to move the spear point 16 from the central position shown in FIG. 5, to an offset position shown in FIG. 6, not only is it necessary to apply a lateral force on the spear point 16 to affect rotation about the pivot axis 20, but in addition the spear point 16 must be moved axially against the bias of the spring 52 to move the pivot axis 20 closer to or beyond the end 36. This action may be accomplished by an operator grabbing the sleeve 22 in one hand, the spear point 16 in another hand, pulling the two components away from each other so as to compress the spring 52, and simultaneously applying a moment to the spear point 16 causing it to pivot about the pivot axis 20 pushing the ball 78 against the bias of the spring 80. Due to the relative configuration of the spear point 16 and the end 36 of the sleeve 22, there is minimal risk of a user jamming or catching their fingers or hand between the spear point 16 and the sleeve 22. In particular this arises due to the shape of the surface 38 and the previously described relationship between the outer diameter of the spear head 16 and inner diameter of the inner surface 42.

When the spear point 16 is pivoted to a point where the ball 78 is aligned with one of the recesses 74 or 76, the detent mechanism 72 operates to hold the spear point 16 in that position. If the user lets go of the spear point 16 before one of there points is reached, the spear point 16 will snap back to the central position by action of abutment of the sleeve 22 (being biased by spring 52) with the spear point 16. The detent 72 is sufficiently strong to hold the spear point 16 in an offset position against the bias of the spring 52. To return the spear point 16 to the central position, an external force is required to rotate the spear point 16 about the pivot axis 20 sufficient to retract the ball 78 against the bias of the spring 80 into the passage 60 to unseat the ball from the recess 74*b*. Once this occurs, the bias of the spring 52 pushing the sleeve 22 against the spear point 16 automatically snaps the spear point 16 back to the central position where the ball 78 will engage the recess 76.

The size of a spear head assembly 12 is matched to the diameter of a drill string in which it is to be used. As a result of this, spear point 16 does not have sufficient room when inside a drill string to pivot about the axis 20 to an extent where the detent mechanism 72 can engage and hold the spear point 16 in an offset position. Accordingly, when located inside a drill pipe, the spear point 16 will always be in the central position thereby maximizing the likelihood of proper engagement with an overshot.

Figure 2:
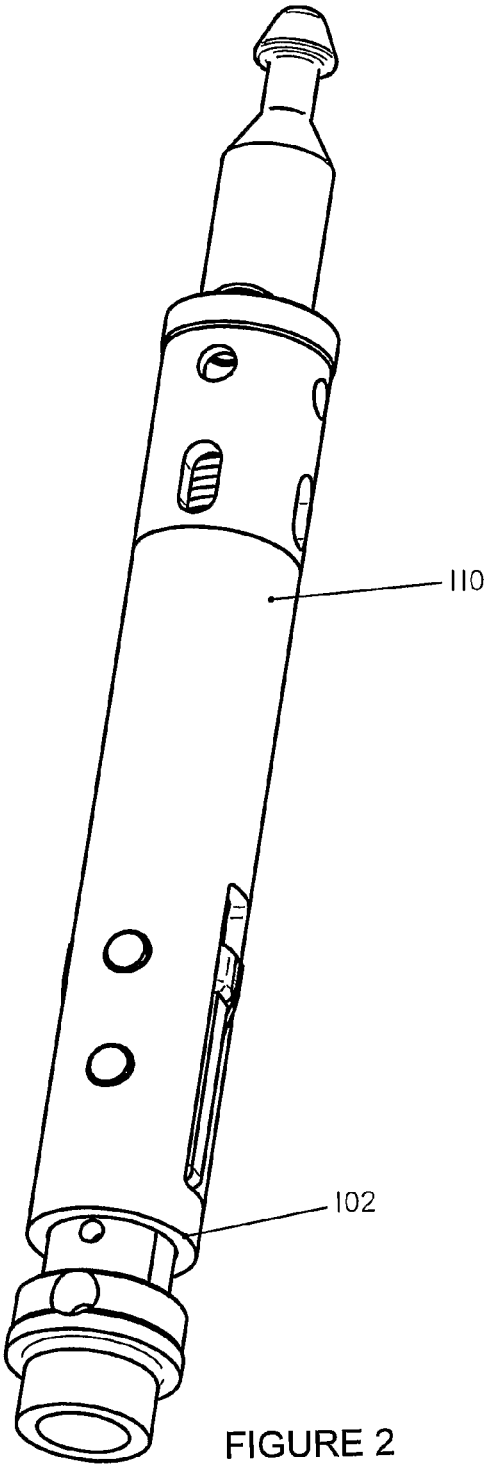
FIG. 2 is a schematic representation of the head assembly shown in FIG. 1 but with the latching system depicted in a release position.
Figure 7:
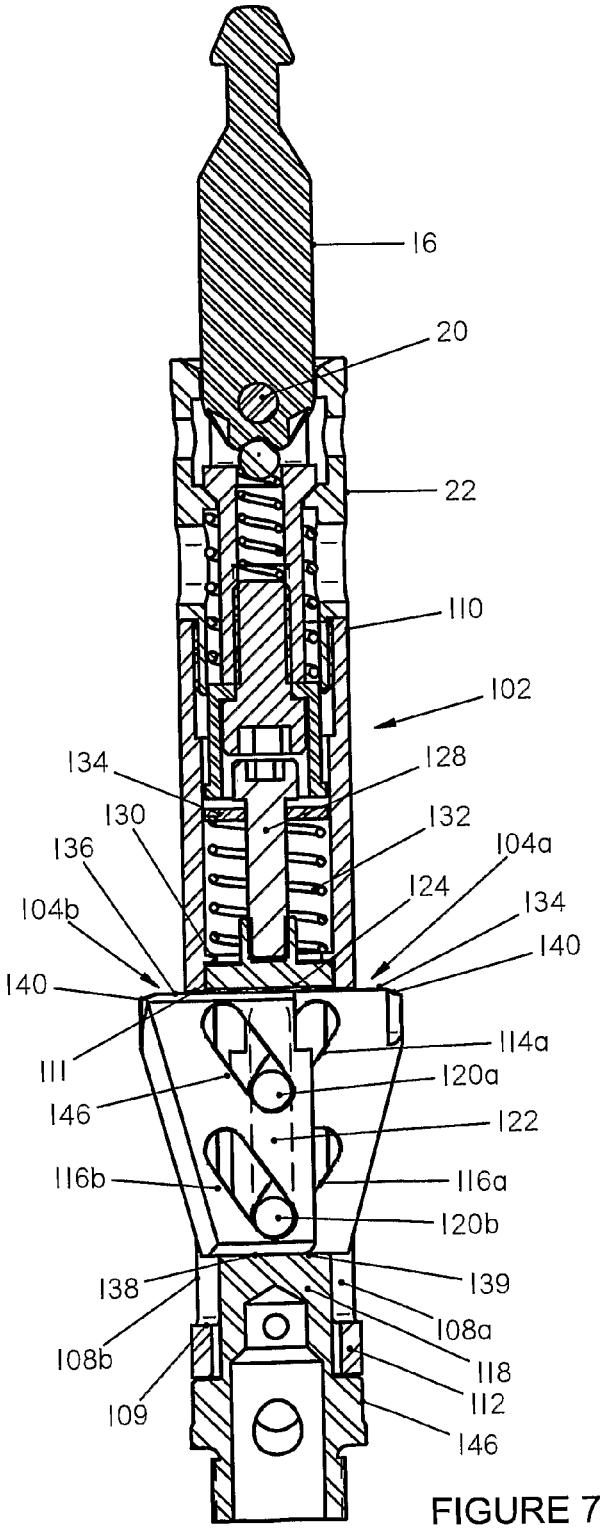
FIG. 7 is a section view of the head assembly shown in FIG. 1.
Figure 8:
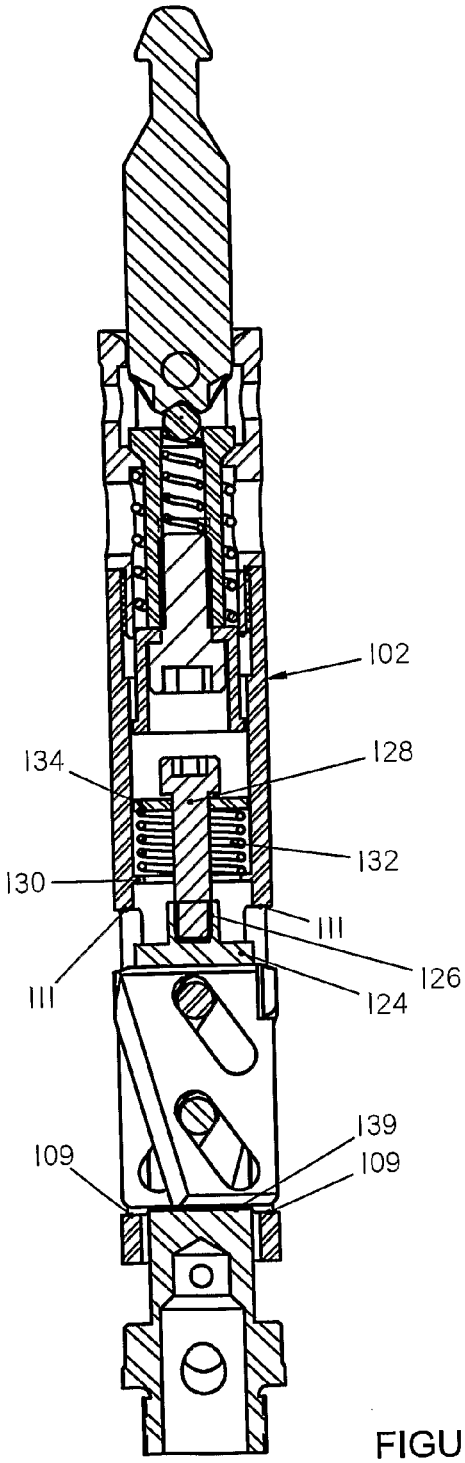
FIG. 8 is a section view of the head assembly shown in FIG. 2.

With particular reference to FIGS. 1, 2, and 7-11 the latching system 100 comprises a latch body 102 and two latch dogs 104*a*, 104*b* (hereinafter referred to in general as "latch dogs 104") that are coupled to the latch body 102 and moveable between a latching position (shown in FIGS. 1 and 7) where the latch dogs extend from the latch body 102 and can engage a latching mechanism and a release position shown in FIGS. 2 and 8 where the latch dogs 104 retract inwardly of the latch body 102 to a position where the latching system 100 can pass through the latching mechanism. More particularly, latch dogs 104 move parallel to each other when moving between the latch and release positions. The parallel motion of the latch dogs 104 is transverse to a longitudinal axis 106 of the latch body 102. The latch dogs 104 move parallel toward each other when the latching system is moved from the latch position to the release position. Conversely, the latch dogs 104 move parallel away from each other when the latching system is moved from the released position toward the latch position.

The latch body 102 is in the form of a hollow tube 106 which is provided with axially extending slots 108*a* and 108*b* (hereinafter referred to as "slots 108"). The slots are formed inboard of opposite ends 110 and 112 of the tube 106. Slots 108 are positioned relative to the dogs 104 so that the latch dogs 104 can extend from and retract into the tube 106 through the slots 108. The slots 108 terminate at opposite ends in planar surfaces 109 and 111.

The parallel motion of the latch dogs is facilitated by the combination of at least two slots formed on each of the latch dogs 104, and corresponding pins that extend through the slots. More particularly, latch dog 104*a* is formed with two slots 114*a* and 116*a* which are of identical shape to each other and are inclined relative to the longitudinal axis of latch body 102. The slots 114*a* and 116*a* are axially offset from each other and oriental so that they at least partially (and indeed in this specific embodiment wholly) overlap each other in the axial direction.

The latch dog 104*b* is also provided with slots 114*b* and 116*b* of identical shape as slots 114*a* and 116*a* but disposed in a mirror image orientation.

The latch dogs 104 are coupled to a latch carrier 118 by pins 120*a* and 120*b* (hereinafter referred to in general as "pins 120"). Each of the pins 120 pass through the tube 106 and through respective pairs of the slots 114 and 116. For example pin 120*a* passes through the slots 114*a* and 114*b* while the pin 120*b* passes through the slots 116*a* and 116*b*. In addition, the latch carrier 118 is formed with a longitudinal slot 122 which extends in the axial direction of the body 102 and through which both of the pins 120*a* and 120*b* pass.

An end 124 of the latch carrier 118 is provided with an axial tube 126 provided with an internal thread that is engaged by a bolt 128. An internal annular land 130 is formed in the latch body 102 through which the tube 126 can extend but beyond which the end 124 of the latch carrier 118 cannot pass. A latch spring 132 extends about a shank of the bolt 128 and is retained between the land 130 and a washer 134 through which the bolt 128 passes. The washer 134 has an outer diameter greater than that of an inner diameter of the land 130. In this way the latch carrier 118 is coupled to the body 102 in a manner allowing relative axial movement there between.

Each of the latch dogs 104 is provided with an upper flat face 136 that lies parallel with and inside of the end 124, and an opposite flat face 138 that is parallel to and inside of a planar face 139 formed on the latch carrier 118 through and perpendicular to the slot 122.

The spacing between the end 124 and the face 139 is fixed, the spacing being slightly greater than the traverse distance between the faces 136 and 138.

Figure 9:
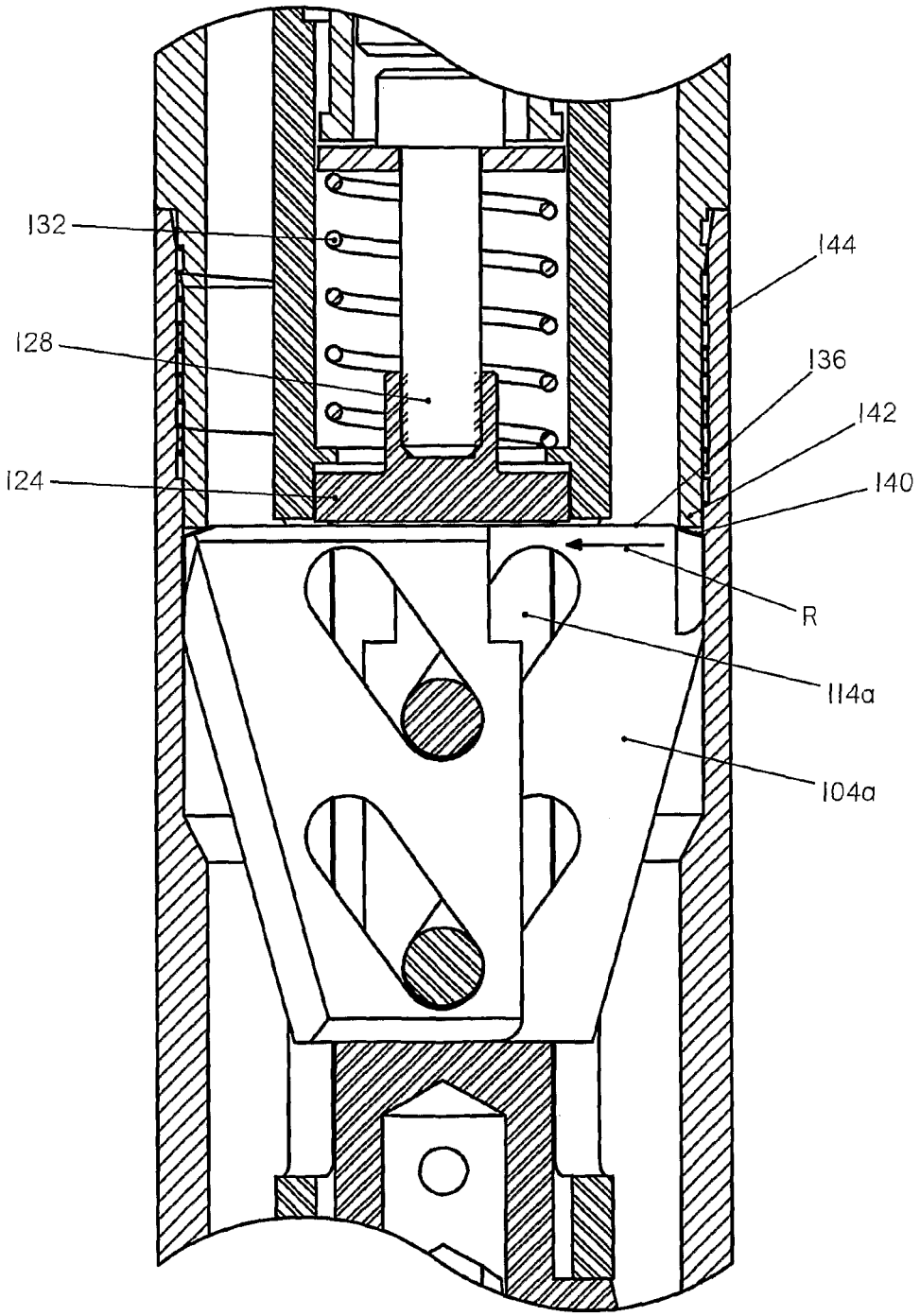
FIG. 9 is an enlarged view of a portion of the latching system engaged with a landing ring.

With particular reference to FIG. 9 a radially outer edge of the surface 136 is provided with a latch face 140. When the latching system 100 is in the latch position, the latch face 140 is in alignment with a latching mechanism in the form of a latching shoulder 142 which is formed in an inside portion of an outer core barrel 144. Accordingly if a force is applied in the axial direction from the latch dogs 104 toward the spear point 16, the latch faces 140 of the latch dogs 104 would be bought into abutment with the latching shoulder 142 preventing the head assembly 10 from moving in an up hole direction. Although not essential, in the present depicted embodiment, the latch face 140 is shown as sloping or inclined so as to from a gap of increasing size in a radial outward direction from a central axis of the latch body 102. The function of the inclined surface 140 will be described shortly.

When no upward pulling force is applied to the spear point 16, the latch spring 132 extends to a length governed by the distance between the washer 134 (abutting the head of the bolt 128) and the land 130 effectively pulling the latch carrier 118 in an upward direction relative to the latch body 102. The motion of the latch carrier body 118 is limited by abutment of an increased diameter portion 146 of the latch carrier 118 with end 112 of the latch body 102 (see FIG. 7). In this configuration, the pins 120 are in effect lowered relative to the latches 104 so that the pins 120 reside in a lower end of the respective slots 114 and 116. In this configuration, the latch dogs 104 are extended radially outward from the slots 108 to a maximum extent.

When it is required to retrieve the head assembly 10, an overshot is lowered into a drill string and engages the spear point 16. A wire line can then be reeled in which applies an upward force on the spear point 16. The upward force applied on the spear point 16 is transferred to the latch body 102. Since the latch faces 140 are engaging the latch shoulder 142 application of the force causes the latch body 102 to move axially relative to the latch carrier 118. This results in the pins 120 sliding axially in an upward direction relative to the carrier 118 and the latch dogs 104. This movement is also accompanied by a compression of the spring 132. Due to the inclination of the slots 114 and 116, the latch dogs 104 move inwardly in a plane parallel to the longitudinal axis of the latch body 102. Thus, with reference in particular to FIG. 9, the latch faces 140 move inwardly toward each other along a radius R of the body 102. Due to the inclination of the latch face 140 as this movement occurs, a gap is created between the latch shoulder 142 and the latch face 140 to facilitate a smooth unlatching of the latch system with minimal friction.

The motion of the latch dogs 104 when the latching system is moving from the latch position to the release position minimizes the likelihood of the latch face 140 sticking or jamming on the latch shoulder 142. This is the case irrespective of whether or not the latch face 140 is parallel with the surface 136 or inclined as shown in FIG. 9. The inclination of the latch face 104 shown in FIG. 9 further reduces the likelihood of jamming occurring.

Figure 10:
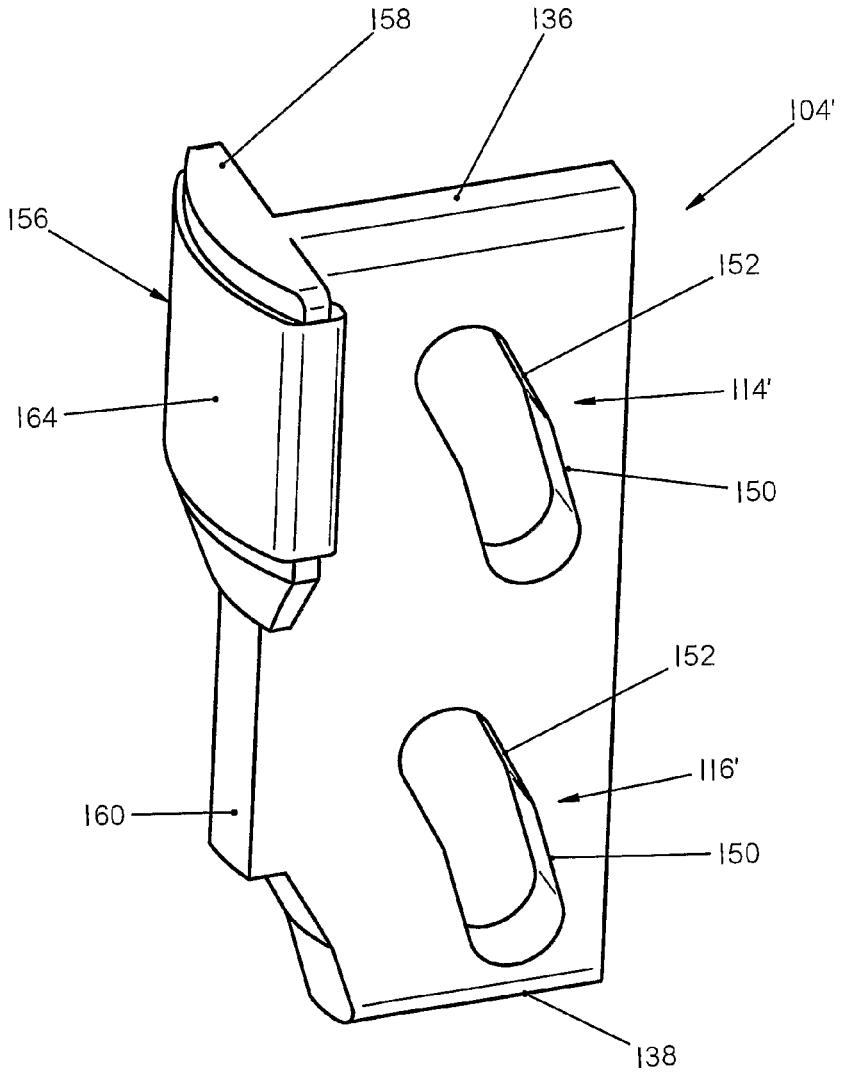
FIG. 10 is a representation of a latch dog in a second embodiment the latching system.
Figure 11:
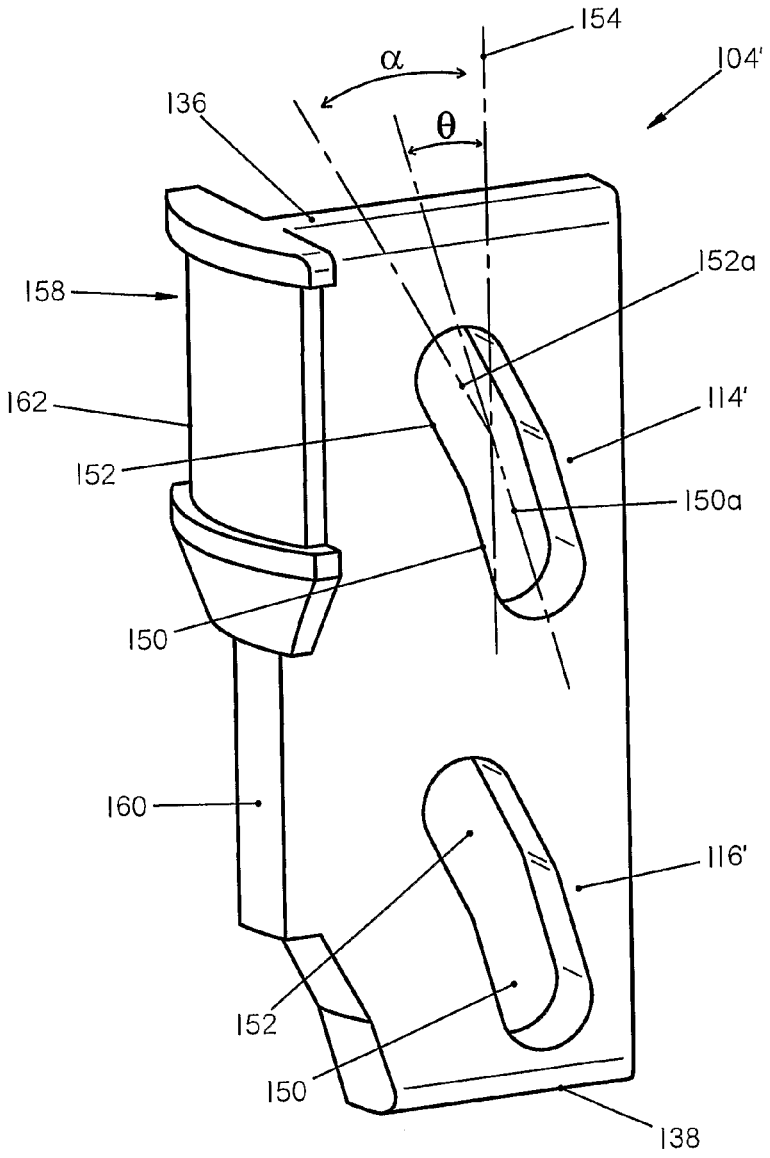
FIG. 11 is a depiction of the latch dog shown in FIG. 10 but with a brake pad removed.
Figure 12:
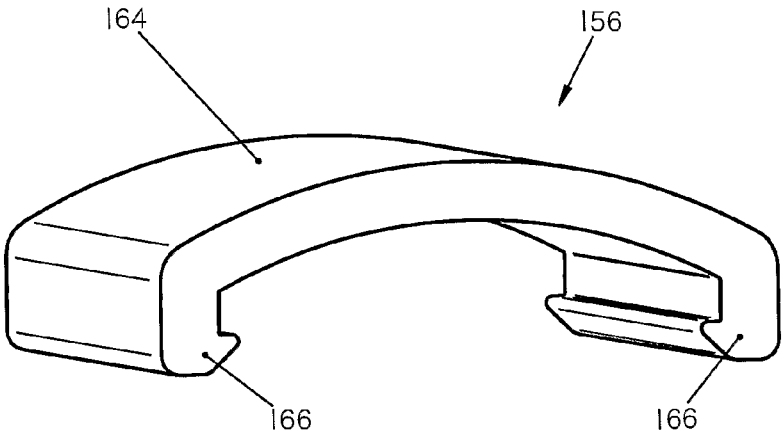
FIG. 12 is a representation of a brake pad incorporated in a latch dog depicted in FIG. 10.

FIGS. 10-12 depict a latch dog 104' that may be incorporated in an alternate embodiment of the present invention. The latch dog 104' differs in two main aspects from the latch dogs 104. Firstly, latch dog 104' comprises slots 114' and 116' which are each formed with two contiguous sections 150 and 152 that are inclined at different angles to the longitudinal axis 154 of the latch body. To highlight this, axis 150*a* and 152*a* are depicted in FIG. 11 being the axes of the slot section 150 and 152 respectively. It can be seen that the angle of inclination θ of the axis 150*a* from the longitudinal axis 154 is smaller than the angle of inclination □ of the axis 152*a* from the longitudinal axis 154. The function of this difference in inclination is described below.

A further distinguishing feature of the latch dogs 104' from the latch dogs 104 is the inclusion of a brake pad 156 carried on a brake shoe 158 which is formed as part of the latch dog 104'. The brake shoe 158 is formed circumferentially of an outer axially extending face 160 of the latch dog 104' and comprises a circumferential recess 162 for seating brake pad 156. The brake pad 156, shown in greatest detail in FIG. 12, is formed in a generally concaved shape having an outer brake surface 164 that in use bears against an inside surface of a drill rod. Opposite ends of the brake pad 156 are formed with inwardly directed catches 166 that catch or clip about opposite ends of the brake shoe 158, as shown clearly in FIG. 10. Typically the brake pad 156 is made of a resilient plastics material enabling a snap fit on to the shoe 158. This also facilitates the easy replacement of brake pads 156.

When the latch dogs 104' are incorporated in to the latch system, the latch system in effect operates and functions as a brake system. Thus the latch dogs 104' in such an embodiment can be considered as brake dogs which act to control the speed of a tool being lowered through a drill string or other tube or conduit. A further modification of the latch system may comprise both latch dogs 104 as shown in FIGS. 7 8 and 9 as well as the latch dogs 104' as shown in FIGS. 10-12, arranged axially relative to each other. Alternately, the latch dogs 104' may be used in place of the latch dogs 104 to provide both a braking and latching function. The inclination of the slot portion 152 relative to the slot portion 150 allows the latch dogs 104' to move radially outward further than latch dog where the slot 114, 116 comprised only a single section having a single axis of inclination, thus compensating for wear of the brake pads 164. Further, the change in angle between slot portions 150 and 152 allows for greater movement of the latch dogs 104 relative to the amount of movement of the latch body 102. That is it changes the ratio of movement between these two components.

Pressure applied by the brake pads 164 against the inside of the drill string can be varied by adjustment of the bolt 128 to increase or decrease the degree of compression of the spring 132.

Modifications and variations of the embodiments of the above invention that would be obvious to a person of ordinary skill in the art are deemed to be within the scope of the present invention the nature of which is to be determined from the above description and the appended claims.

What is claimed is:

1. A spear head assembly comprising:

a spear point having a proximal end and an opposite pointed end;

a sleeve having an axial passage and a first end from which the spear point extends wherein an outer diameter of the spear point is marginally smaller than an inner diameter of an inner circumferential surface of the sleeve so as to provide minimal clearance there between; and a post extending axially through and coupled to the sleeve, wherein the spear point is pivotally connected to the post about a pivot axis by a pivot pin and the post is movable axially within the sleeve, wherein the spear point can pivot about the pivot axis between a central position where the pivot axis lies within the sleeve and a longitudinal axis of the spear point is substantially parallel to a central axis of the sleeve, and one or more offset positions where the longitudinal axis of the spear point is not parallel to the central axis of the sleeve and the spear point bears on the first end of the sleeve to move the post axially relative to the sleeve as the spear point moves between the central position and one or more of the offset positions.

2. The spear head assembly according to claim 1, further comprising:

a first spring biasing the post and spear point inward of the sleeve.

3. The spear head assembly according to claim 2, wherein the spear point is biased by the first spring toward the central position.

4. The spear head assembly according to claim 3, further comprising:

a detent mechanism configured for holding the spear point in any one of the offset positions against the bias applied by the sleeve.

5. The spear head assembly according to claim 4, wherein the detent mechanism includes a plurality of recesses formed on an outer surface of the spear point and a member biased to seat in one of the recesses.

6. The spear head assembly according to claim 5, further comprising:

a detent spring retained in the post, wherein the member is disposed between the pivot axis and the detent spring.

7. The spear head assembly according to claim 4, wherein the detent mechanism is configured for releasably holding the spear point in the central position.

8. The spear head assembly according to claim 1, wherein the spear point is rotatable about the central axis of the sleeve.

* * * * *